US006264391B1

(12) United States Patent
Kroha

(10) Patent No.: US 6,264,391 B1
(45) Date of Patent: Jul. 24, 2001

(54) REVERSIBLE SOAP BAG

(76) Inventor: Sally S. Kroha, 3541 N. Hermitage Ave., Chicago, IL (US) 60657

( * ) Notice: Subject to any disclaimer, the term of this patent is extended or adjusted under 35 U.S.C. 154(b) by 0 days.

(21) Appl. No.: 09/292,428

(22) Filed: Apr. 15, 1999

(51) Int. Cl.[7] ..... A47K 7/02; A47L 13/19

(52) U.S. Cl. ..... 401/201; 15/227; 206/77.1; 224/218; 383/74; 383/75; 383/117; 401/8

(58) Field of Search ..... 224/218, 219, 224/674, 675; 401/7, 8, 200, 201; 15/104.93, 104.94, 227; 206/77.1; 383/117, 74, 75, 25; 150/110

(56) References Cited

U.S. PATENT DOCUMENTS

| | | | | |
|---|---|---|---|---|
| D. 317,401 | * | 6/1991 | Earnest | D9/305 |
| D. 355,805 | | 2/1995 | Warren . | |
| D. 372,340 | | 7/1996 | Wendel . | |
| D. 381,540 | | 7/1997 | Guiliano . | |
| 1,469,917 | * | 10/1923 | Dessau | 401/201 |
| 2,160,921 | * | 6/1939 | Stroop | 401/201 |
| 2,574,854 | * | 11/1951 | West | 15/104.93 |
| 2,607,940 | * | 8/1952 | Miller | 383/117 |
| 2,617,569 | * | 11/1952 | Sommer | 383/117 |
| 3,124,827 | * | 3/1964 | Hull | 15/104.93 |
| 3,377,121 | * | 4/1968 | Billesbach et al. | 206/77.1 |
| 3,581,447 | * | 6/1971 | Falivene | 401/201 |
| 3,711,889 | | 1/1973 | Jennings . | |
| 3,870,419 | | 3/1975 | Sage . | |
| 3,969,256 | | 7/1976 | Hadley et al. . | |
| 4,154,542 | | 5/1979 | Rasmason . | |
| 4,190,550 | | 2/1980 | Campbell . | |
| 4,228,834 | | 10/1980 | Desmick . | |
| 4,308,157 | | 12/1981 | Di Giovanna . | |
| 4,343,061 | | 8/1982 | Hanazono . | |
| 4,457,640 | | 7/1984 | Anderson . | |
| 4,457,643 | | 7/1984 | Caniglia . | |
| 4,480,939 | | 11/1984 | Upton . | |
| 4,741,852 | | 5/1988 | Ondracek . | |
| 4,761,849 | | 8/1988 | Taylor . | |
| 4,789,262 | | 12/1988 | Sanchez . | |
| 4,795,268 | * | 1/1989 | Jordá | 383/117 |
| 4,969,225 | | 11/1990 | Schubert . | |
| 5,011,316 | | 4/1991 | Damon . | |
| 5,022,517 | | 6/1991 | Benitez . | |
| 5,029,802 | | 7/1991 | Ali . | |
| 5,031,759 | | 7/1991 | Ogilvie . | |
| 5,050,999 | * | 9/1991 | Van Loon | 383/117 |
| 5,144,744 | | 9/1992 | Campagnoli . | |
| 5,207,725 | | 5/1993 | Pinkerton . | |
| 5,211,494 | | 5/1993 | Baijnath . | |
| 5,219,340 | * | 6/1993 | Seneca | 604/290 |
| 5,238,307 | * | 8/1993 | Mooney et al. | 383/74 |
| 5,279,412 | | 1/1994 | Lee . | |
| 5,326,610 | | 7/1994 | Moss . | |

(List continued on next page.)

FOREIGN PATENT DOCUMENTS 0863201 9/1998 (EP) .

*Primary Examiner*—Stephen P. Garbe
(74) *Attorney, Agent, or Firm*—Orum & Roth

(57) ABSTRACT

An improved soap bag that secures a bar of soap in the palm of a user's hand during bathing. The soap bag (10) includes a body (12) and a band (14) formed from synthetic mesh material and contains a bar of soap therein. Body (12) is comprised of first panel (16) and second panel (18) and band (14) is comprised of third panel (32) and fourth panel (34). First panel (16) includes first wash surface (24), second panel (18) includes second wash surface (26), third panel (32) includes third wash surface (36), and fourth panel (34) includes fourth wash surface (38). The soap bag of the present invention is reversible between first and second positions, exposing first and third surfaces (24 & 36) in the first position, and second and fourth surfaces (26 & 38) in the second position. A closing means is attached to the body portion (12) and is comprised of a drawstring and cordstop.

10 Claims, 2 Drawing Sheets

U.S. PATENT DOCUMENTS

| | | | | |
|---|---|---|---|---|
| 5,366,125 | | 11/1994 | Procido . | |
| 5,390,971 | | 2/1995 | Warren . | |
| 5,417,462 | * | 5/1995 | Hensley | 383/75 |
| 5,462,378 | | 10/1995 | Webb . | |
| 5,486,064 | | 1/1996 | Schulte . | |
| 5,667,612 | | 9/1997 | Benge . | |
| 5,671,498 | | 9/1997 | Martin . | |
| 5,704,723 | | 1/1998 | Salisian . | |
| 5,713,094 | | 2/1998 | Markey et al. . | |
| 5,715,561 | | 2/1998 | Tuthill . | |
| 5,727,278 | | 3/1998 | Per-Lee . | |
| 5,787,541 | | 8/1998 | Chen . | |
| 5,787,542 | | 8/1998 | Chien . | |
| 5,791,519 | | 8/1998 | Marcke . | |
| 5,839,842 | * | 11/1998 | Wanat | 401/201 |
| 5,845,994 | * | 12/1998 | Rice | 383/74 |
| 5,857,794 | | 1/1999 | Chien . | |
| 5,895,163 | * | 4/1999 | Chapman | 383/117 |

* cited by examiner

REVERSIBLE SOAP BAG

BACKGROUND OF THE INVENTION

1. Field of the Invention

The present invention relates to soap bags and more particularly to a soap bag that facilitates a user's easy manipulation and firm grasping of a bar of soap contained therein, manufactured from various mesh materials, and allowing the user to rapidly alternate between four separate wash surfaces of the soap bag.

2. Description of Related Art

Bar soap is a popular personal care item that presents some well-documented problems. One problem using bar soap is the inability to lather the body properly and efficiently while bathing. A bar of soap is slippery and comes in many different shapes and sizes presenting a problem when applying the soap and generating sufficient lather to different parts of the body. Slippery soap can result in the soap dropping and breaking during use. This broken soap may be discarded and wasted. Additionally the user may be unable to retrieve the fallen soap, particularly users with physical disabilities.

Another problem is soap that sits in a soap dish can get soft and mushy resulting in waste and a messy soap dish that is time consuming to clean. Frequently small soap pieces are discarded resulting in waste. Yet another problem is the difficulty bathers have in getting clean while using only the bar of soap without a washcloth to scrub the skin and complete the bathing process.

It is known to use soap bags and shower mitts for bathing and dispensing soap, however, the known devices do not provide a soap bag manufactured from a variety of mesh materials that prevent a bar of soap from slipping out of a users hand and does not limit the users finger dexterity by fitting over the entire hand. The known devices additionally do not accommodate soap of all shapes and sizes, are not easily used on irregular surfaces such as between toes and behind ears, will not dispense soap according to the users needs at a predetermined rate, and do not rapidly alternate between various wash surfaces such as coarse scrubbing or exfoliating surfaces and gentle washing or buffing surfaces depending on the user's needs.

SUMMARY OF THE INVENTION

The principal object of the invention is to provide a soap bag adapted to receive a bar of soap that facilitates the gripping and manipulation of a bar of soap by a user. It is also an object of the invention to provide a soap bag that does not limit the finger dexterity of the user and is easily used to clean irregular surfaces such as between toes and behind ears.

It is also an object of the invention to provide a soap bag that is reversible allowing a user to rapidly alternate between four separate wash surfaces.

It is also an object of the invention to provide a soap bag manufactured from a variety of mesh or netted materials and to provide wash surfaces made of different mesh or netted materials. It is an object of the invention to provide a soap bag with a coarse mesh material comprising one wash surface and a soft mesh material comprising another wash surface of the bag. This combination of mesh materials can accommodate a user's desire for a particular scrubbing surface used on body parts having different tactile sensitivity.

It is also an object of the invention to provide a soap bag having a body that forms a pouch and a band secured to the body. The soap bag can be utilized by either hand of the user, can accommodate any size or shape of soap bar, and can conform to the shape of the bar of soap contained therein.

It is also an object of the invention to provide a soap bag wherein the user can control the release of soap and control the desired amount of lather generated from the bar of soap contained within the soap bag of present invention.

It is a further object of the invention to provide a combination soap bag and wash cloth that reduces the disintegration of a bar of soap contained therein, reduces soap waste and cleans and stimulates a users' skin.

Other aspects and advantages of the invention will become apparent from the following specification taken in connection with the accompanying drawings.

DESCRIPTION OF THE PREFERRED EMBODIMENT

Figure 1:
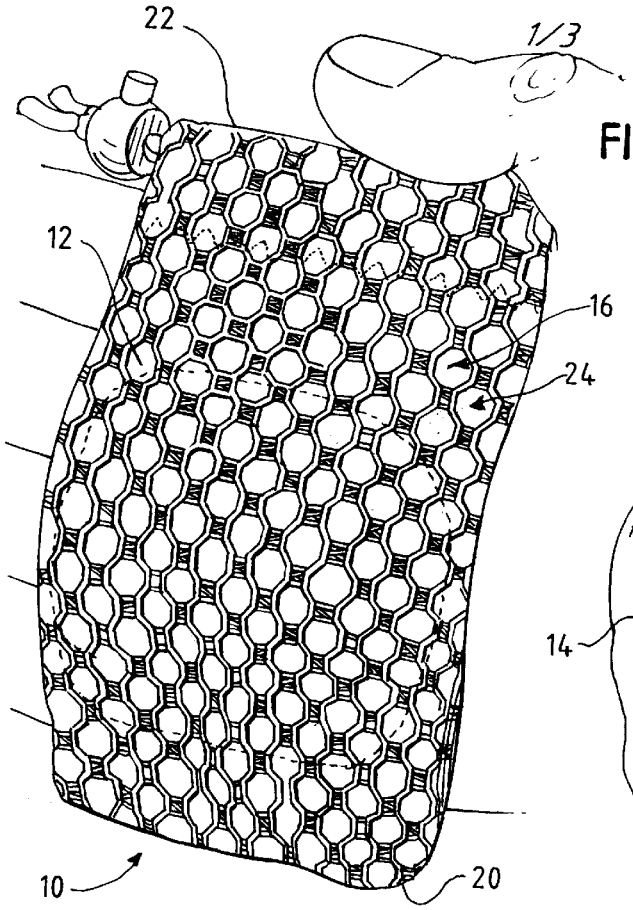
FIG. 1 is a front perspective view of the soap bag of the present invention showing a first surface.
Figure 4:
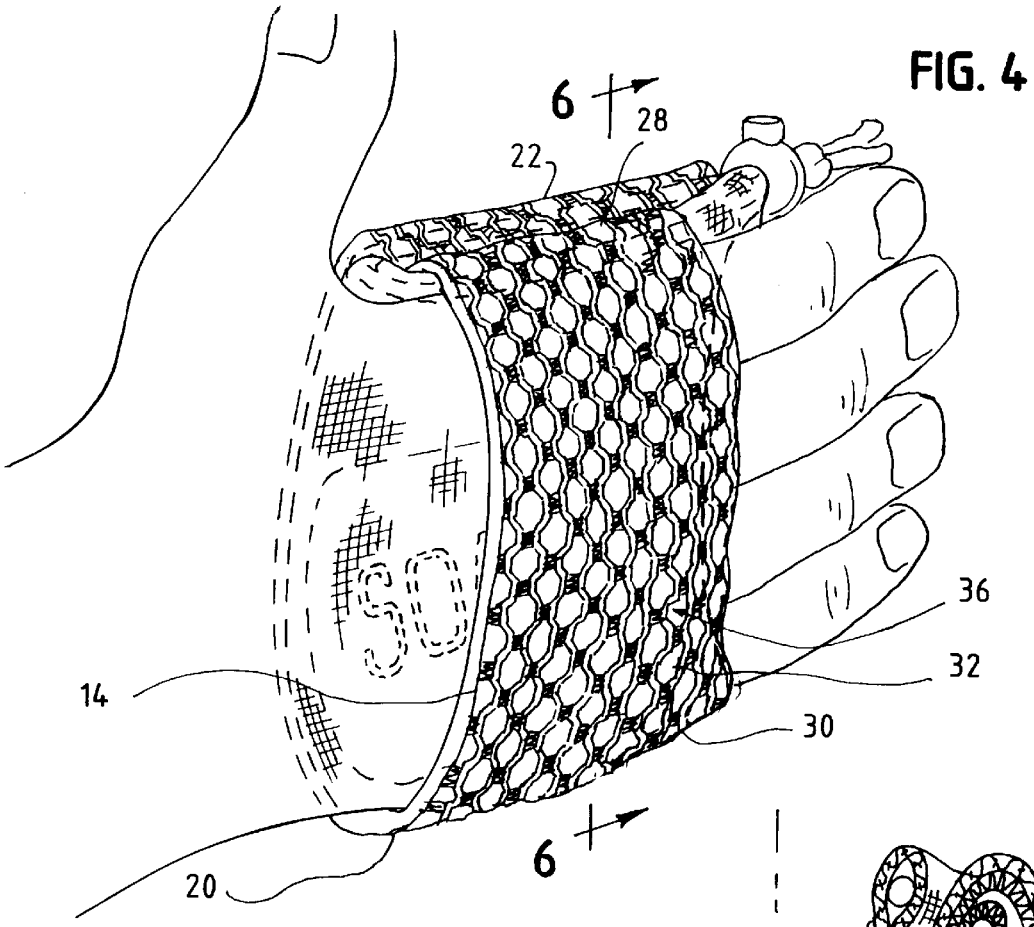
FIG. 4 is a rear perspective view of a soap bag according to the present invention, showing a third surface.

In the illustrated embodiment as disclosed in FIGS. 1 and 4, a soap bag, generally designated 10, made according to the invention, is seen to include a body 12 and a band 14. Body 12 and band 14 are manufactured from a flexible synthetic or organic material that is permeable to, yet not disintegratable in water. Preferably, the body 12 and band 14 are manufactured from a mesh or netted material made from an Afghan mesh fabric of 100% polyester, having ⅛ inch diameter holes, and a webbing between each adjacent hole.

Figure 6:
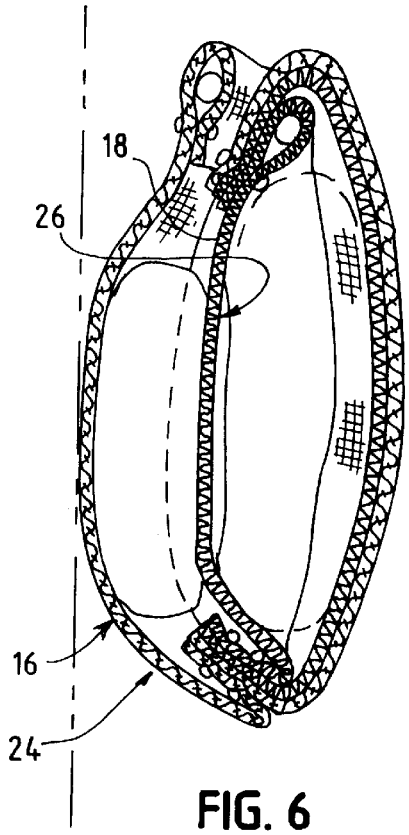
FIG. 6 is a cross sectional view along line 6—6 of FIG. 4 of the soap bag of the present invention.

Body 12 as seen in FIGS. 1 and 6, is comprised of a first panel 16 and a second panel 18. The first panel 16 and second panel 18 are both generally rectangular, generally of equal size, and include an outside perimeter around each panel 16 and 18. The panels 16 and 18 are sewn or heat sealed together around a majority of each perimeter forming a pouch in the body 12 of the soap bag 10. The pouch of the body 12 has a closed end 20 and an open end 22 and is adapted to receive a bar of soap therein.

Figure 2:
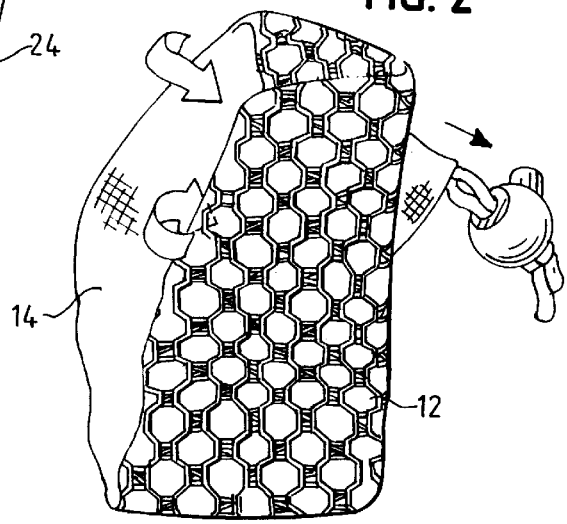
FIG. 2 is a perspective view of the soap bag of the present invention in the process of reversing a first position to a second position.
Figure 3:
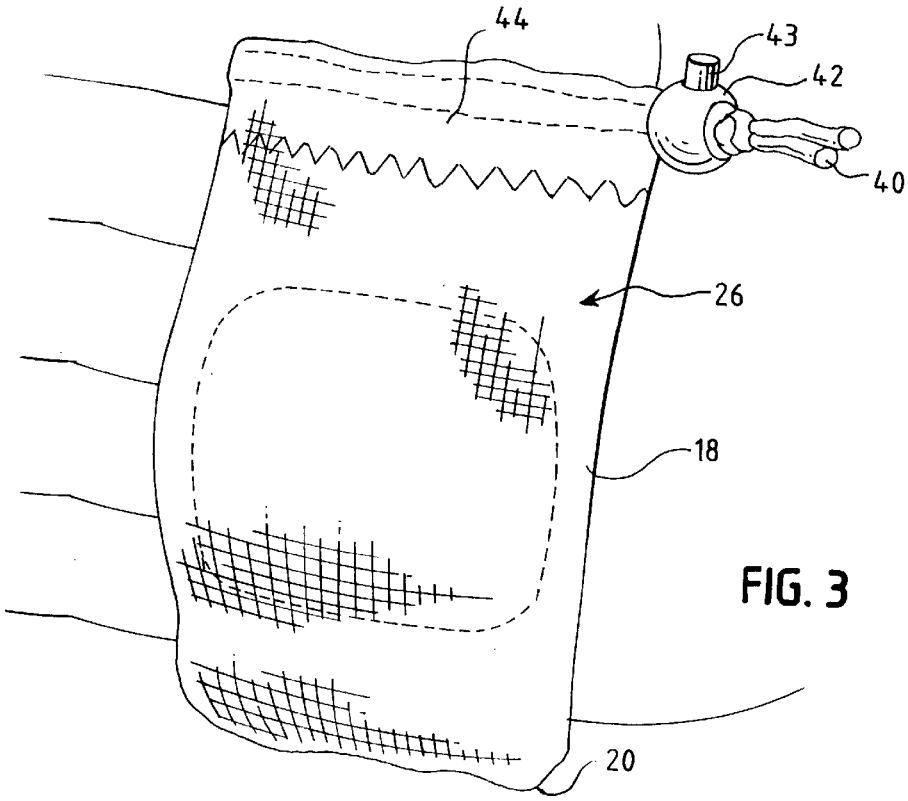
FIG. 3 is a front perspective view of the soap bag of the present invention reversed from FIG. 1, showing a second surface.

First panel 16 has a first surface 24, and second panel 18 has a second surface 26. First and second panels 16 and 18 can be manufactured from the same mesh or netted material, or in the alternative, as shown in FIGS. 1–3, panels 16 and 18 are manufactured from different mesh or netted materials. Panel 16, as shown in FIG. 1, is manufactured from a soft mesh material having a loose weave, and panel 18, as shown in FIG. 3, is manufactured from a coarse mesh material having a tight weave. Alternatively, the weave of each panel may be constructed such that a loose weave results in a coarse mesh material and a tight weave results in a soft mesh material.

Band 14 is securely attached to body 12 as seen in FIG. 4. Band 14 has a first end 28, a second end 30, and is comprised of third panel 32 and fourth panel 34. First end 28 of band 14 is attached to open end 22 of body 12, and second end 30 of band 14 is attached to closed end 20 of body 12, while maintaining a detached area between first and second ends 28 and 30 of band 14.

Third panel 32 and fourth panel 34 are generally rectangular, generally of equal size, and sewn or heat sealed together at first and second ends 28 and 30, as shown in FIG. 4. Alternatively, third panel 32 and fourth panel 34 can be sewn or heat sealed together around a majority of each perimeter, or around the entire perimeter of panels 32 and 34.

Figure 5:
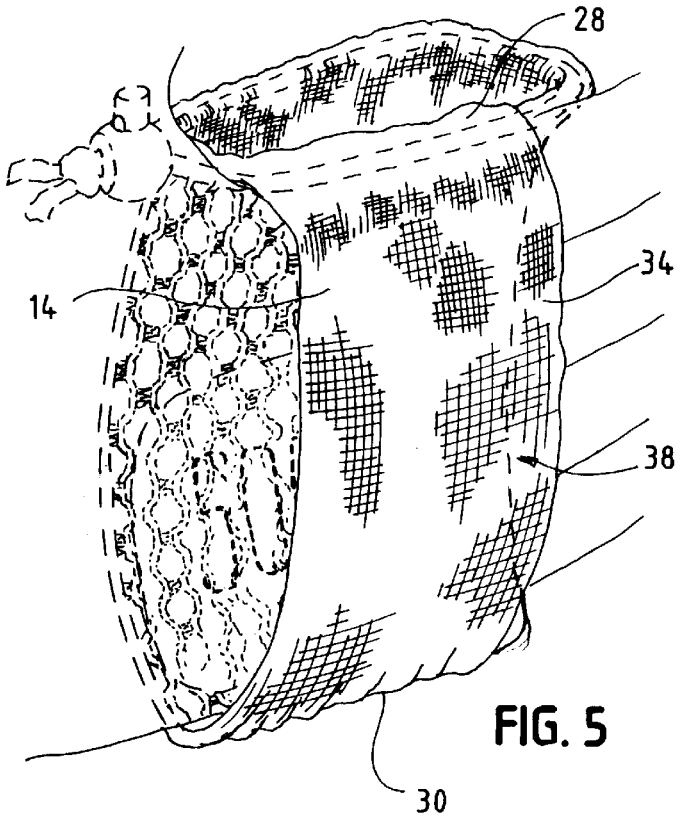
FIG. 5 is a rear perspective view of the soap bag of the present invention, reversed from FIG. 4, showing a fourth surface.

Third panel 32 of band 14 has a third surface 36, and fourth panel 34 of band 14 has a fourth surface 38, as shown in FIGS. 4 and 5. Similar to panels 16 and 18 of body 12, panels 32 and 34 of band 14 are manufactured from a mesh or netted material of different weaves, or alternatively from mesh or netted material of the same weave. As shown in FIG. 4, panel 32 is manufactured from a soft mesh material having a loose weave, and panel 34 is manufactured from a coarse mesh material having a tight weave. Once again the weave of each panel may also be constructed such that a loose weave results in a coarse mesh material and a tight weave results in a soft mesh material.

Alternately, in another embodiment, band 14 is comprised of only one panel of mesh or netted material securely attached to body 12 at closed end 20 and open end 22, leaving a detached area between ends 20 and 22. In another embodiment, band 14 is formed from a narrow strap manufactured from a flexible material such a rubber or terry cloth, secured to ends 20 and 22 of body 12, leaving a detached area between both ends as described above.

The soap bag of the present invention is reversible between first and second positions, as seen in FIGS. 1–5, while maintaining a bar of soap contained therein. The first position exposes first surface 24 of body 12, and third surface 36 of band 14. The second position exposes second surface 26 of body 12, and fourth surface 38 of band 14. The soap bag of the present invention is rapidly reversed between four different wash surfaces 24, 26. 36 and 38, each possibly made from different textured mesh materials, providing a bather with a variety of wash surfaces used on body parts having different tactile sensitivity.

For example, when the soap bag is in a first position, as seen in FIGS. 1 and 4, first and third wash surfaces 24 and 36 are exposed, providing a bather with soft surfaces with which to lather and gently wash. By reversing the soap bag of the present invention to a second position, as seen in FIGS. 3 and 5, second and fourth wash surfaces 26 and 38 are exposed, providing a bather with coarse wash surfaces with which to exfoliate or scrub. As the soap bag of the present invention is reversed, as shown in FIG. 2, between the first and second positions as discussed above, a bar of soap is maintained within the pouch of body 12.

Body 12 and band 14 collectively facilitate the gripping and manipulation of a bar of soap by a user, and use of all four wash surfaces 24, 26, 36, and 38, while maintaining a bar of soap in the soap bag 10.

A closing means is attached to the open end 22 of body portion 12 and is comprised of a drawstring 40 and cord stop 42 as seen in FIGS. 1 and 3. In another embodiment, a closing means is comprised of a drawstring and a slipknot. In still another embodiment, a closing means is comprised of Velcro™ strips positioned along the open end 22 of the body 12.

A perimeter of the open end 22 of body 12 includes a channel 44 as shown in FIG. 3. Drawstring 40 is threaded through channel 44 and the adjustable cord stop 42 is secured to the drawstring 40. The drawstring 40 is preferably manufactured from nylon string, having an ⅛ inch diameter, but can be manufactured from a synthetic or organic string or cord of various diameters.

Cord stop 42 is preferably manufactured from plastic containing a metal or plastic biasing spring (not shown) and a plunger 43. Cord stop 42 may also be manufactured from a material that floats in water, and additionally may be shaped like a character or article appealable to children, such as an animal or car, etc.

From the foregoing it will be readily appreciated that a soap bag according to the present invention is inexpensively fabricated, secures a bar of soap in the hand of a bather without limiting the bather's finger dexterity, and can be used in both a bather's right or left hand. Additionally, the soap bag acts as a washcloth, is able to clean irregular body parts, such as between toes and behind ears, enables the bather to control the amount of lather released, and provides an efficient, simply designed bag that reduces soap waste, can store and dry soap when not in use, provides an easy vehicle to use small soap chips and cleans and stimulates a user's skin.

What is claimed is:

1. A soap bag, comprising:

a body of mesh material forming a pouch having an open end, a closed end, and a wash surface;

a band of mesh material secured to said body, having a first end, a second end, and a band wash surface, and a closing means attached to said open end of said body for securely closing said open end of said pouch while in use, said body and said band manufactured from different mesh materials, said first end of said band attaching to the open end of said body and said second end of said band attaching to the closed end of said body, while maintaining a detached area between first and second ends of said band, whereby said pouch of said body is adapted to receive a bar of soap therein and said band and said pouch collectively facilitate the gripping and manipulation of a bar of soap by a user and use of the pouch and band wash surfaces.

2. A soap bag, comprising:

a body of material forming a pouch having an open end, a closed end, and first and second wash surfaces;

a band secured to said body, having a first end, a second end, and third and fourth band wash surfaces;

a closing means attached to said open end of said body for securely closing said open end of said pouch while in use, said first and second wash surfaces are manufactured from different mesh materials, said first end of said band attaching to the open end of said body and said second end of said band attaching to the closed end of said body, while maintaining a detached area between first and second ends of said band, said soap bag is reversible between first and second positions, such that said first position of said bag exposes said first and third wash surfaces, and said second position of said bag exposes said second and fourth wash surfaces, whereby said pouch of said body is adapted to receive a bar of soap therein and said band and said pouch collectively facilitate the gripping and manipulation of a bar of soap by a user and use of the pouch and band wash surfaces.

3. The soap bag according to claim 2 wherein one of said body and band is a meshed material manufactured from nylon.

4. The soap bag according to claim 2 wherein one of said body and band is a meshed material manufactured from polyester.

5. The soap bag according to claim 2, wherein said body includes a drawstring channel around a perimeter of the open end, and said closing means includes a drawstring threaded through said drawstring channel and an adjustable cord stop.

6. A soap bag, comprising:

a body of material forming a pouch having an open end, a closed end, and first and second wash surfaces;

a band secured to said body, having a first end, a second end, and third and fourth band wash surfaces;

a closing means attached to said open end of said body for securely closing said open end of said pouch while in use, said third and fourth wash surfaces are manufactured from different mesh materials, said first end of said band attaching to the open end of said body and said second end of said band attaching to the closed end of said body, while maintaining a detached area between first and second ends of said band, said soap bag is reversible between first and second positions, such that said first position of said bag exposes said first and third wash surfaces, and said second position of said bag exposes said second and fourth wash surfaces, whereby said pouch of said body is adapted to receive a bar of soap therein and said band and said pouch collectively facilitate the gripping and manipulation of a bar of soap by a user and use of the pouch and band wash surfaces.

7. The soap bag according to claim 6, wherein said body includes a drawstring channel around a perimeter of the open end, and said closing means includes a drawstring threaded through said drawstring channel and an adjustable cord stop.

8. A soap bag, comprising:

a body of material forming a pouch having an open end, a drawstring channel around a perimeter of the open end, a closed end, and a wash surface;

a band secured to said body, having a first end, a second end, and a body wash surface; and a closing means attached to said open end of said body for securely closing said open end of said pouch while in use, said closing means includes a drawstring threaded through said drawstring channel and an adjustable cord stop, said first end of said band attaching to the open end of said body and said second end of said band attaching to the closed end of said body, while maintaining a detached area between first and second ends of said band, whereby said pouch of said body is adapted to receive a bar of soap therein and said band and said pouch collectively facilitate the gripping and manipulation of a bar of soap by a user and use of the pouch and band wash surfaces.

9. The soap bag according to claim 5 wherein said cord stop is manufactured from a material that floats in water.

10. The soap bag according to claim 5 wherein said cord stop is manufactured from plastic.

* * * * *